US007028609B2

(12) United States Patent
Ozga et al.

(10) Patent No.: US 7,028,609 B2
(45) Date of Patent: Apr. 18, 2006

(54) HOOPING APPARATUS HAVING A BAND APPLICATION FRAME WITH AT LEAST ONE BAND-FEEDING ELEMENT

(75) Inventors: Joerg Ozga, Bayreuth (DE); Ingrid Pfaffenberger-Schneider, Bindlach (DE)

(73) Assignee: Schneider & Ozga, Bindlach (DE)

( * ) Notice: Subject to any disclaimer, the term of this patent is extended or adjusted under 35 U.S.C. 154(b) by 223 days.

(21) Appl. No.: 10/206,675

(22) Filed: Jul. 29, 2002

(65) Prior Publication Data

US 2003/0033941 A1 Feb. 20, 2003

(30) Foreign Application Priority Data

Jul. 28, 2001 (DE) ..... 101 36 938

(51) Int. Cl.
*B65B 13/04* (2006.01)

(52) U.S. Cl. ..... 100/26; 100/35

(58) Field of Classification Search ..... 100/8, 100/26, 29, 32, 33 R, 35; 53/399, 589
See application file for complete search history.

(56) References Cited

U.S. PATENT DOCUMENTS

| | | | | |
|---|---|---|---|---|
| 3,379,121 A | | 4/1968 | Lems | |
| 3,783,773 A | * | 1/1974 | Willard et al. | 100/7 |
| 4,079,667 A | | 3/1978 | Lems et al. | |
| 5,078,057 A | | 1/1992 | Pearson | |
| 5,373,686 A | * | 12/1994 | Lang et al. | 53/589 |
| 5,560,180 A | * | 10/1996 | Rodriguez et al. | 53/399 |
| 5,577,371 A | | 11/1996 | Lang et al. | |
| 5,680,813 A | * | 10/1997 | Schwede | 100/26 |
| 5,842,327 A | | 12/1998 | Schwede | |

FOREIGN PATENT DOCUMENTS

| | | | |
|---|---|---|---|
| DE | 1 586 913 | | 9/1971 |
| DE | 41 00 276 C2 | | 11/1991 |
| DE | 195 03 112 A1 | | 8/1996 |
| DE | 196 32 728 A1 | | 8/1998 |
| DE | 0905025 | * | 3/1999 |
| EP | 0 905 025 A1 | | 3/1999 |

* cited by examiner

*Primary Examiner*—Allen Ostrager
*Assistant Examiner*—S Self
(74) *Attorney, Agent, or Firm*—Sughrue Mion, PLLC

(57) ABSTRACT

Apparatus for hooping packing units that includes a working table (1), on which a packing unit (3) can be placed during hooping, and a band application frame (5), disposed so as to be fixed and eccentric and running obliquely to the working surface of the working table (1), for applying a band loop (9) from a band section of a hooping band. At least one band-feeding element (14; 15; 19; 19') is disposed on the band application frame. The band-feeding element traverses the band loop roughly into the middle of the working table for subsequently hooping the packing unit in the direction of conveyance (4).

23 Claims, 7 Drawing Sheets

HOOPING APPARATUS HAVING A BAND APPLICATION FRAME WITH AT LEAST ONE BAND-FEEDING ELEMENT

The following disclosure is based on German Patent Application No. 10136938.7, filed on Jul. 28, 2001, the disclosure of which is incorporated into this application by reference.

FIELD OF AND BACKGROUND OF THE INVENTION

The present invention relates to an apparatus and an associated method for hooping packing units. An apparatus of this type is, for example, known from German Laid-Open Publication DE-A-196 32 728 (corresponding to European Patent Application EP 0 905 025 A1). The hooping apparatus known from this document is also called a longitudinal hooping apparatus because the direction of conveyance of the packing unit to be hooped and the hooping direction of the hooping band are identical. Therefore, the packing unit is hooped in the direction of conveyance. For hooping, the packing unit is first traversed onto a working table that forms part of the apparatus, in order to then be hooped on the working table in the next step of the operation. For problem-free traversability of the packing unit onto the working table, the hooping band is mounted in a hooping frame pivotable about a longitudinal axis running in the direction of conveyance. The transporting of the packing unit onto or off of the working table is done simply in such a way that, prior to feeding and prior to removing the packing unit, the hooping frame is pivoted far enough away from the working table that it makes the working surface of the working table accessible and thus no longer stands in the way of the packing unit.

Disadvantageous in this known hooping apparatus is the fact that the entire hooping frame with its entire mass must always be completely pivoted away before each transport step. This pivoting requires a certain expenditure of time and thus acts as a bottleneck factor for the speed of the hooping apparatus.

To avoid the movement of the entire mass of the hooping frame, a hooping apparatus is known, e.g., from German Laid-Open Publication DE-A-195 03 112 (corresponding to U.S. Pat. No. 5,680,813 to Schwede), in which the hooping band is inserted and drawn taut around the packing unit simply with the aid of compressed air and with the aid of an insertion and withdrawal device. Due to the low stability of form of the hooping band the precision of guiding and positioning of the hooping band in this case is to be regarded as disadvantageous.

Finally, German Patent DE-C 41 00 276 (corresponding to U.S. Pat. No. 5,078,057 to Pearson) discloses a so-called cross hooping apparatus. This hooping apparatus has a band application frame disposed with a lateral offset with respect to the direction of conveyance. This band application frame is multiply curved and wound within itself so that it is disposed in the upper area once again more toward the middle of the working table in the direction of conveyance. With the aid of this band application frame a multiply curved and wound hooping band loop is applied. This falls to a certain extent in the direction of the goods to be hooped and is drawn taut with the aid of a retightening device. Disadvantageous in this case are the curves and windings of the hooping band forming the band loop. Particularly disadvantageous in this connection is the so-called "formation of sabers" to be found again and again in hooping bands.

Therein the hooping band is twisted in its longitudinal plane because it is conducted during its production around several rollers. In the area of these rollers, the breaks in the longitudinal plane, the so-called sabers, arise at the reversing points on stretching and forming of the plastic hooping band. With curves and windings in the band-feeding channel, these sabers lead to the hooping band repeatedly becoming entangled. A further disadvantage in the case of this known cross hooping machine is the fact that the applied hooping band loop is no longer reliably guided after its release from the guide channel of the band application frame.

OBJECTS OF THE INVENTION

An object of the invention is to configure a hooping apparatus so that, despite high operational speed, the apparatus positions the hooping band precisely on the packing unit. Another object of the invention is to configure a hooping apparatus that avoids the need to pivot the entire hooping frame with its entire mass.

SUMMARY OF THE INVENTION

These and other objects are solved by the apparatuses and methods claimed. According to one formulation, the invention provides an apparatus for hooping packing units that includes: a working table on which a packing unit can be placed during the hooping operation; a band application frame that is disposed fixed, eccentric and running obliquely relative to a working surface of said working table, and that is configured to apply a band loop from a band section of a hooping band; and at least one band-feeding element that is disposed on the band application frame. The band-feeding element traverses the band loop substantially into the middle of the working surface of the working table for hooping the packing unit in a direction of conveyance of the packing unit.

The invention is based on the concept of configuring a frame as a band application frame so that it is disposed so as to be fixed with respect to the working table and does not have to be moved to feed the hooping band. It is expedient to fix the band application frame directly on the working table. In order not to hinder the transport of the packing unit onto or off of the working table, the band application frame is disposed eccentrically and to a certain extent to the side of the working table and runs obliquely to the working surface of the working table. Before the hooping—preferably at the same time as providing the working table with a packing unit—a band section of a hooping band is laid in the band application frame to form a band loop. With the aid of a separate band-feeding element disposed on the band application frame, this laid-in band loop is traversed roughly into the middle of the working table and placed around the packing unit to be hooped. The hooping process itself is done in the case of the apparatus according to the invention in the customary manner, namely by drawing the hooping band taut on the packing unit and subsequently bonding the bands of the hooping band.

The packing unit in connection with the invention can be a closed package as well as a stack of individual objects, for example, a stack of sheets, magazines, or the like. Packages or cartons of this type are, for example, hooped in mail rooms after the cartons have been processed so as to be ready for shipment. Any goods and articles can be packed in the packing units. In principle any packing unit fitting the working table can be hooped with the hooping apparatus according to the invention.

An advantage of the invention is the fact that, in traversing the band loop from the band application frame into the hooping position roughly in the middle of the working table, only low masses have to be moved, namely on the one hand the negligibly low mass of the hooping band and on the other hand the mass of the band-feeding element, which is also relatively low, in comparison to the conventional hooping frame itself. These low movable masses make it possible to rapidly feed the band loop for hooping and thus to increase the number of cycles of the apparatus. The oblique arrangement of the band application frame relative to the table surface has the advantage that the laid-in band loop has to be traversed over only a short distance from its starting position into the hooping position roughly in the middle of the table. Entanglement of the band loop or other disturbances in the work process are hardly possible over this short distance. The feed stroke covered by the band loop is consequently very small. In addition, this small feed stroke promotes the high speed of the apparatus.

Preferred embodiments of the invention relate to both extensions and advantageous refinements of the invention itself and to innovations that are, at least in part, considered inventive in themselves. These embodiments include a first embodiment of the band-feeding element as a telescoping arm. A pneumatic drive on the one hand and an electromotive drive on the other hand are regarded as preferred drives for the telescoping arm.

An additional embodiment with low mass is a band conveyor provided as a band-feeding element. This band conveyor is advantageously a transport belt with low mass. An advantage of the band conveyor or band belt is the fact that the belt always runs in one single direction, so to speak, infinitely. Unlike the other embodiments, a band conveyor, after feeding the band loop roughly into the middle of the working table, does not have to reverse direction and traverse back into its starting position. Therefore the return stroke, otherwise customary after the working stroke, is avoided. The band conveyor or the preferred belt can be configured as a permanently revolving transport belt, i.e., a continuous conveyor. It is equally well possible to use a timed transport belt, i.e., a discontinuous conveyor.

To improve the guiding action of the hooping band loop, a resistance belt revolving in the direction opposite to the transport belt can be provided. This resistance belt runs above the transport belt so that the transport belt and the resistance belt, in the manner of two jaws lying against the hooping band loop, guide and transport the hooping band loop conveyed between them into its hooping position. Alternatively to the resistance belt, it is also possible to provide a resistance profile above the transport belt.

Further embodiments relate to types of belts which are advantageous to use and which are commercially available as standard parts. Using such belts avoids the need to keep specialized replacement parts, and the associated expense, and avoids the need for expensive self-repairs. Moreover, standard parts can be used. As types of belts, round belts, wedge belts, toothed belts, profile belts, or flat belts preferentially come into consideration, as well as mixed forms of these individual types of belts. It is particularly advantageous to provide, on the transport belt, one or more catches for entraining the hooping band. In particular, it is possible to arrange the catches so that a catch always conveys a hooping band loop into the hooping position of the apparatus such that, as the present catch reaches the hooping position, the next catch already assumes its ready position on the band hooping frame. As a result, as the initial hooping band loop is tightened, and e.g. also bonded together, in the hooping process, the next hooping band loop is entrained from the band application frame and transported into the hooping position.

An additional embodiment of the band-feeding element is a pivot lever. Therein it is particularly advantageous if the pivot axis for the pivot lever is disposed below the working surface of the working table. Thus the otherwise dead space below the working table is constructively used as a mounting space for the bearing and the drive of the pivot lever. However, it is possible just as well to dispose the pivot axis of the pivot lever above the working surface of the working table, for example, even on the upper frame part of the band application frame, so that the pivot lever pivots from above.

According to refinements of this embodiment, the band-feeding element may be configured as a pivoted lever that laterally flanks the packing unit even during the hooping process. In this configuration, the pivot arm always leaves free sufficient working space for the packing unit to be hooped. In other words, it is ruled out in the case of this embodiment that a wide packing unit and the pivot lever collide. Therefore, in any position of the pivot lever, sufficient free space is always available as working space for the packing unit to be hooped. It is particularly advantageous to provide the pivot lever with at least two bends, each defining roughly a right angle, in such a manner that the pivot lever laterally flanks the packing unit, since such a design is relatively simple to manufacture.

The band-feeding element may also be configured as an air nozzle. This air nozzle utilizes a targeted air stream to convey the band loop that lies in the band application frame by impulse into the middle of the working table, for subsequent hooping of the packing unit. The advantage of this embodiment is the fact that, except for the mass of the band section forming the band loop, no masses have to be moved, so that the speed, and thus also the number of cycles per unit of time, of the hooping machine can advantageously be increased. Furthermore, no moving parts for band feeding have to be maintained and repaired in this embodiment.

According to another embodiment, not only one band-feeding element is disposed on the band application frame but rather an arrangement in pairs of two band-feeding elements is provided. Either in conjunction with this embodiment or separately, the band application frame can be implemented as an inverted U, which is particularly simple in construction. This design promotes a break-free run of the hooping band during application of the band loop. Furthermore, such a band application frame reduces the formation of sabers on the hooping band during the application of the band loop. Advantageously, two band-feeding elements are provided in respective corners of the U-shaped band application frame.

BRIEF DESCRIPTION OF THE DRAWINGS

The invention will be explained in more detail with the aid of the exemplary embodiments represented in the drawings. Shown are.

DETAILED DESCRIPTION OF THE PREFERRED EMBODIMENTS

Figure 1A:
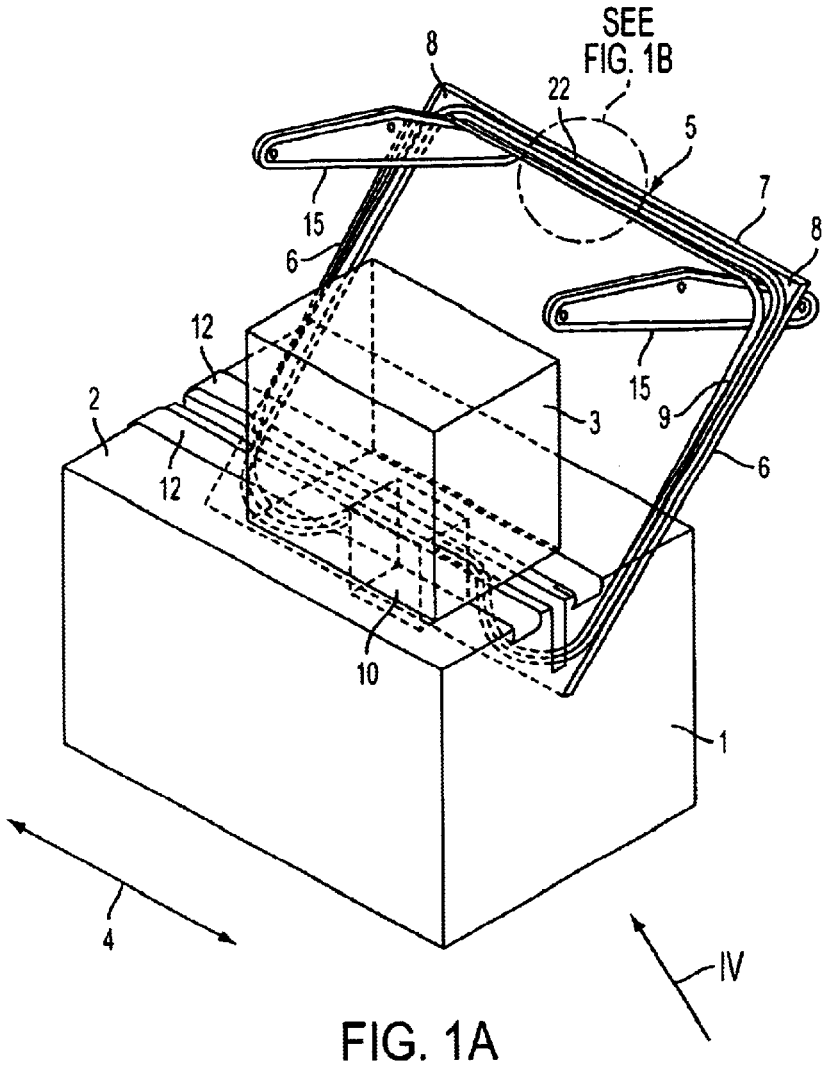
FIG. 1 a perspective representation of a working table of the apparatus according to the invention with transport belts, disposed as a pair, as band-feeding elements, and with a band loop already secured and exiting from the guide groove of the band application frame, FIG. 2 the perspective view of FIG. 1 with the band loop transported about halfway to its hooping position, FIG. 3 the perspective view of FIG. 1 and FIG. 2 with the band loop in its hooping position, FIG. 4 a side view of the feed side of the apparatus according to arrow IV in FIG. 1, FIG. 5 the view from FIG. 4 of an embodiment of the apparatus with a telescoping arm as a band-feeding element, FIG. 6 the view from FIG. 5 of an embodiment of the apparatus with a pivoted lever as a band-feeding element, and FIG. 7 the view from FIG. 6 of an embodiment of the apparatus with a special form of the pivoted lever.
Figure 1B:
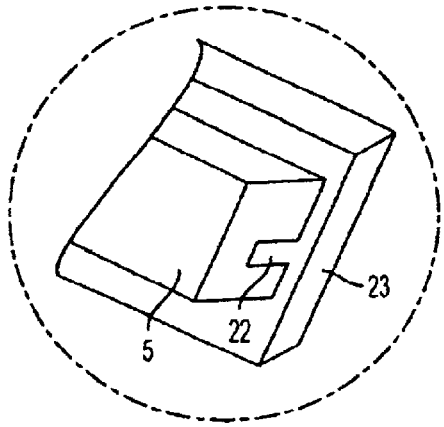

As shown in FIG. 1, the working table 1 has a working surface 2 on which a packing unit 3 can be placed. Before hooping, the packing unit 3 is brought in the direction of conveyance 4 onto the working surface 2 of the working table 1. The hooping itself is also done in the direction of conveyance 4. Mounted on the working table 1 is the band application frame 5 extending obliquely to the working surface 2.

The band application frame 5 has the form of an inverted U whose U-legs 6 form the lateral parts of the band application frame 5 and whose transverse U-base 7 forms the upper part of the frame. In the embodiment of FIG. 1 a separate transport belt 15, as a band-feeding element, projects out of each of the corner areas 8 of the U-shaped band application frame 5. Furthermore, a bonding device 10, disposed below the working surface 2 of the working table 1, is schematically indicated in FIG. 1, as well as the conveyance elements 12 for conveying the packing unit 3 in the direction of conveyance 4.

A C-shaped guide groove 22 for the hooping band runs in the U-legs 6 or transverse U-base 7 respectively forming the lateral parts or the upper part of the band application frame 5. A band loop 9 from the hooping band is laid in the guide groove 22. In FIG. 1 the laid-in band loop 9 is already resting on the transport belts 15. The band loop 9 has just left the guide groove 22 and is being entrained by the transport belts 15.

Finally, FIG. 1 shows a detailed drawing of the C-shaped guide groove 22 in the band application frame 5. In this detailed drawing it can be seen that the band application frame 5 consists of the actual band application frame 5 and a supporting structure 23 preferably consisting of a flat iron bar.

In the additional figures the parts identical to embodiment of FIG. 1 are provided with identical reference numbers. Always represented is a packing unit 3 to be hooped, which is resting on the conveyor belts 12, which in turn are disposed on the working surface 2 of the working table 1.

Figure 2:
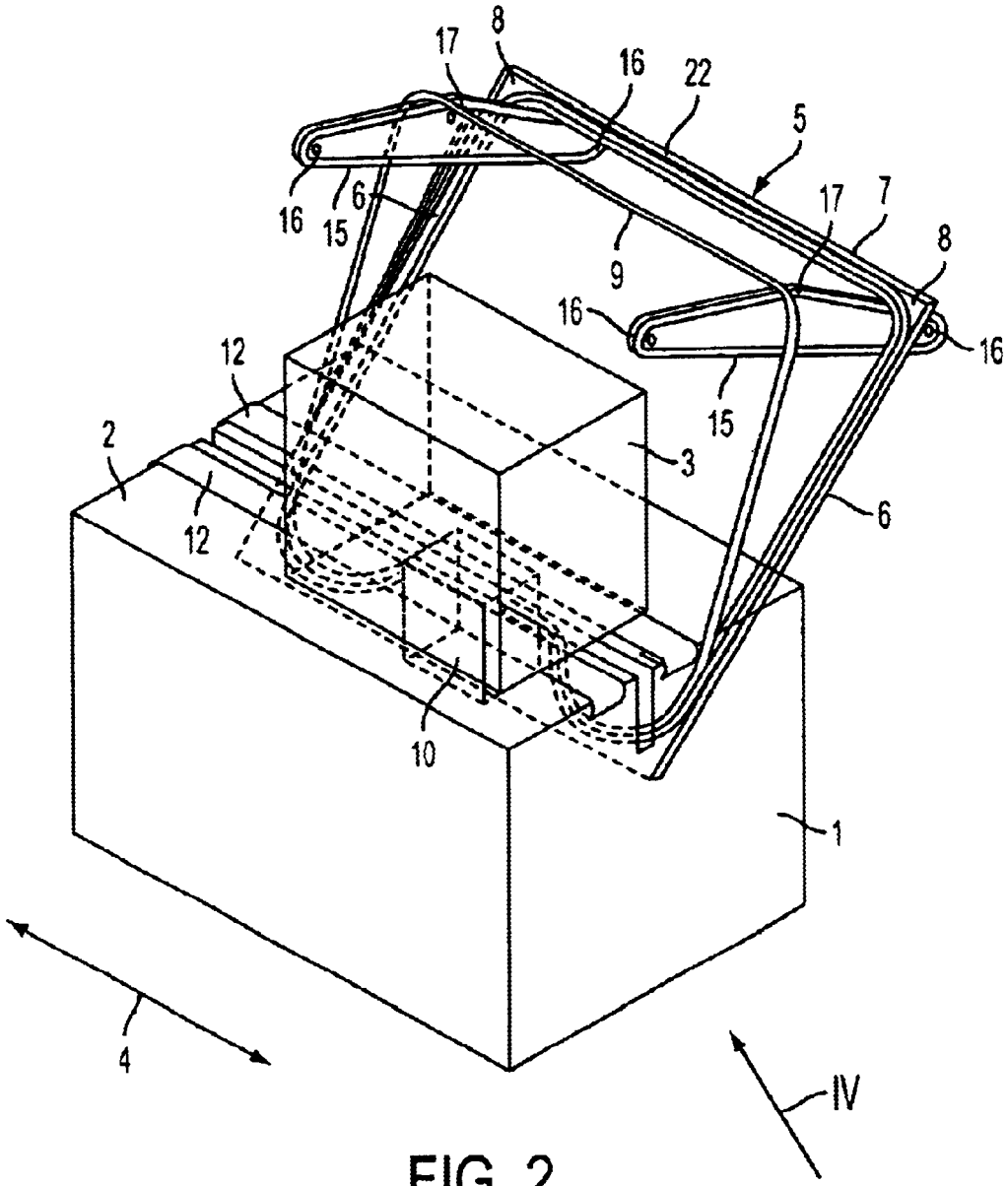
Figure 3:
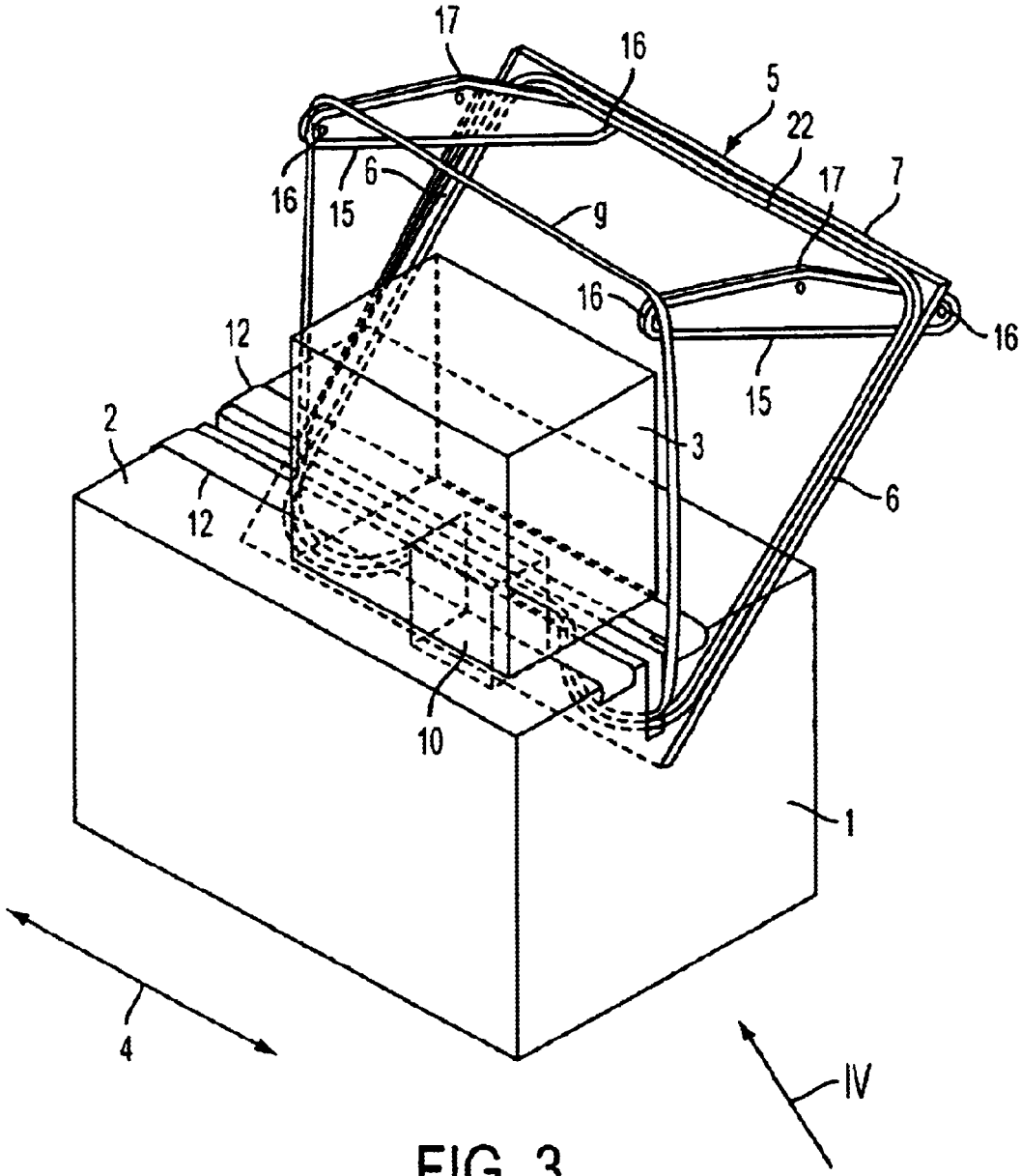

In FIG. 2 the band loop 9 has already been conveyed, by the transport belts 15 conducted around the deflection rollers 16, roughly to the middle of the band-feeding elements at the level of the tightening rollers 17. In FIG. 3 the band loop 9 has finally reached its hooping position. For hooping the packing unit 3 the band loop 9 is released by the band-feeding elements, i.e., by the transport belts 15 in this embodiment. With an insertion and retightening device, which is not represented in the drawing but with which the hooping band is first inserted into the band application frame 5, the band loop 9, after its release by the transport belts 15, is drawn taut around the packing unit 3. To conclude the hooping process the band ends of the band loop 9 are bonded by the bonding device 10. The band loop 9 is reliably conducted only a short distance to the middle of the packing unit by the band application frame 5 in order to subsequently hoop the packing unit 3 reliably with respect to position.

Figure 4:
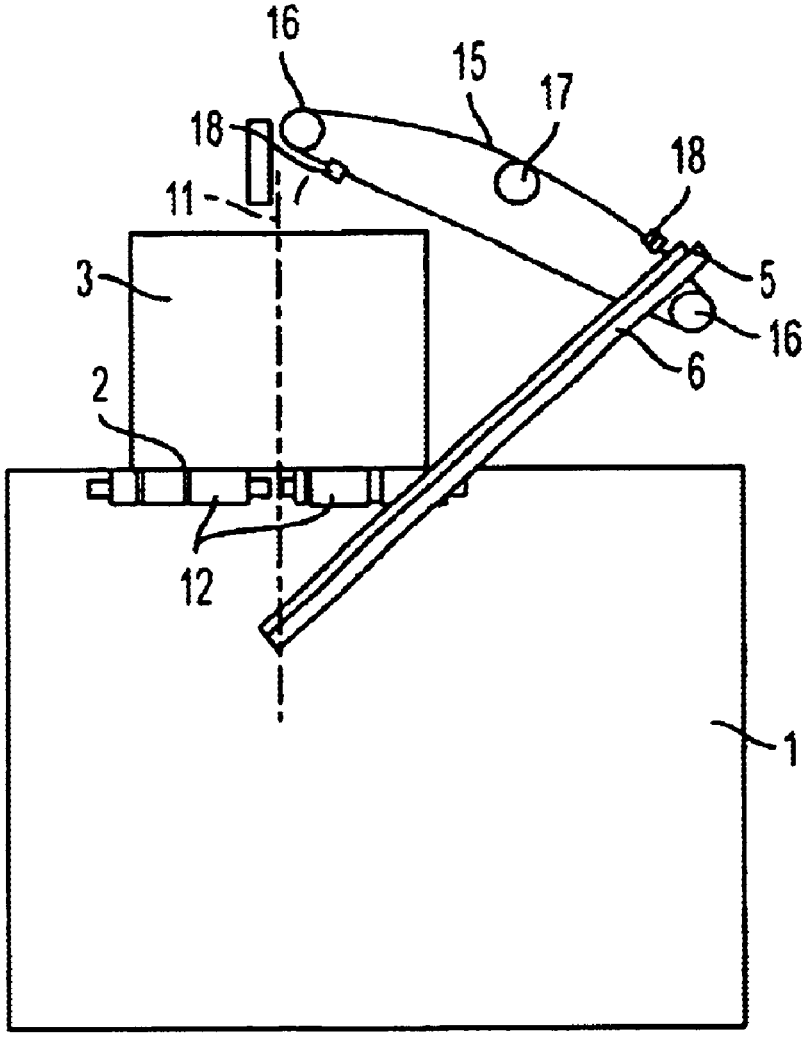

FIG. 4 shows the feed side of the apparatus represented in FIG. 1, FIG. 2, and FIG. 3 according to the arrow IV in FIG. 1, FIG. 2, and FIG. 3. Represented once again are, forming the one band-feeding element, the transport belt 15 and its deflection roller 16 and a tightening roller 17. Furthermore, to be seen in this embodiment, which is slightly modified with respect to the embodiment shown in FIG. 1, FIG. 2, and FIG. 3, are two additional catches 18 diametrically opposite one another on the transport belt 15. These catches 18 are disposed so that one catch 18 entrains the following band loop 9 from out of the band application frame 5 when the other catch 18 has reached the middle 11 of the packing unit and thus has brought the preceding band loop 9 into the hooping position.

Figure 5:
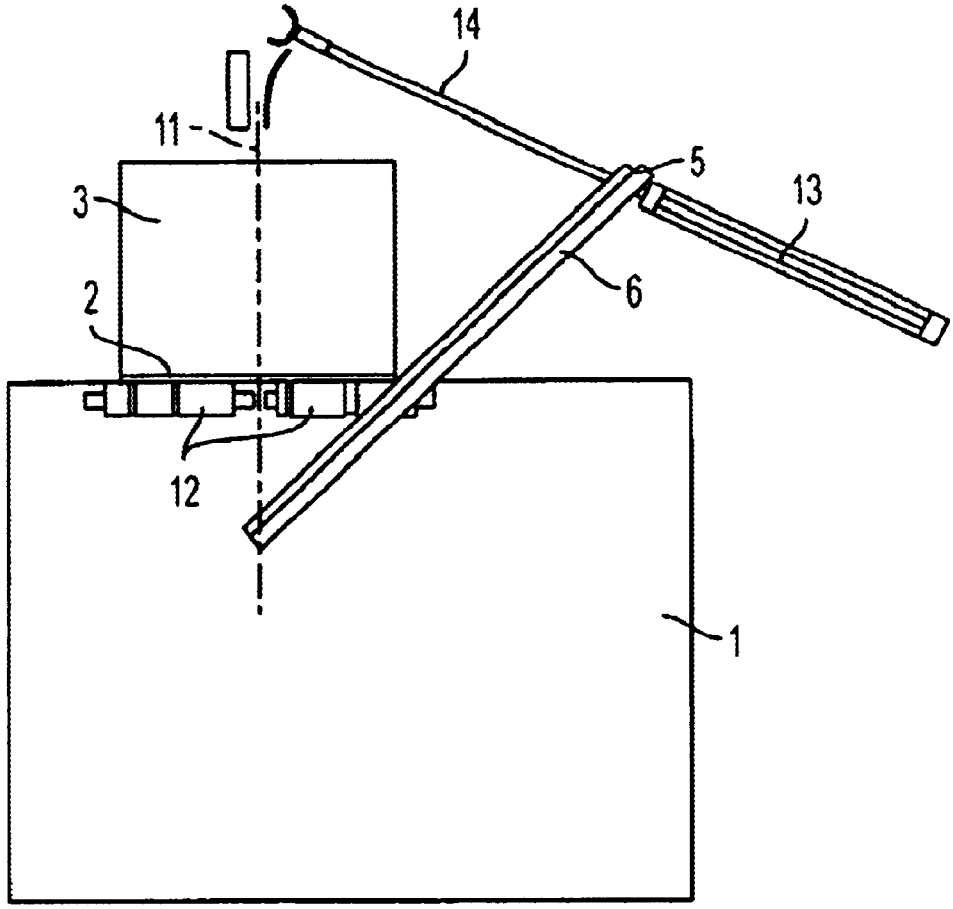

FIG. 5 shows an additional embodiment of the invention with a telescoping arm 14 as a band-feeding element. In this embodiment the telescoping arm 14 is driven by a pneumatic cylinder 13. FIG. 5 shows the telescoping arm 14 completely extended, i.e., analogously to FIG. 3, with the band loop 9 shortly before its release from the band-feeding element for hooping the packing unit 3.

Figure 6:
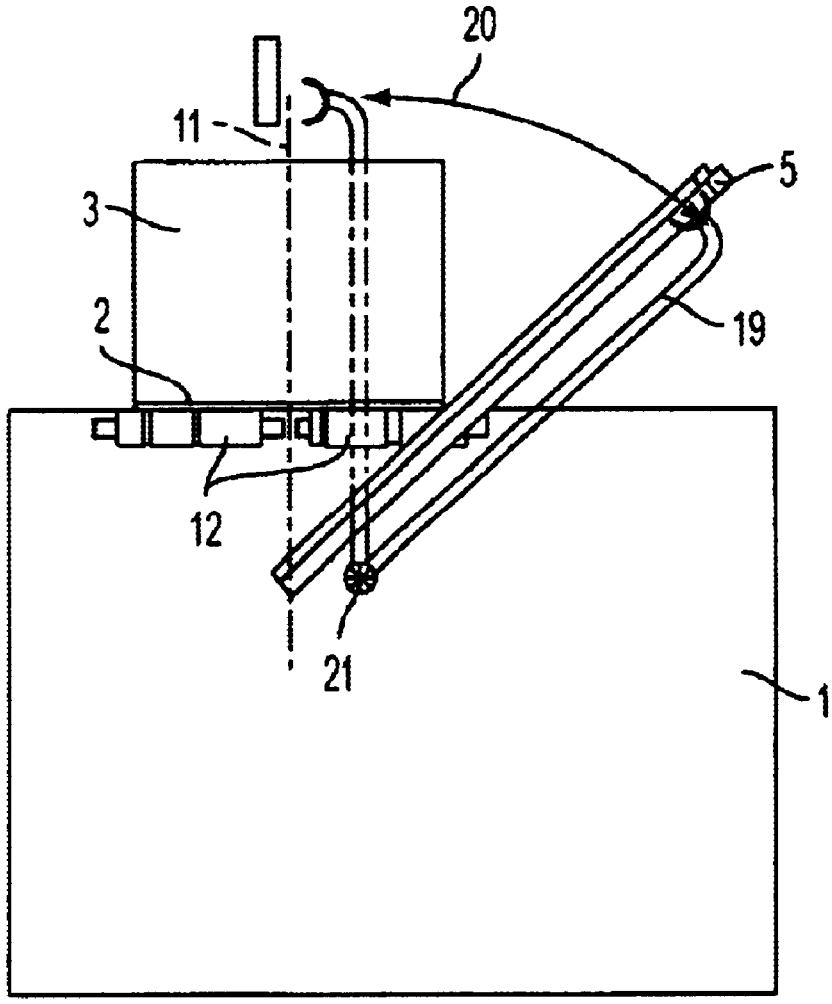

Finally, FIG. 6 relates to an embodiment of the invention with a pivoted lever 19 as a band-feeding element. In FIG. 6 the pivoted lever 19 is disposed adjacent to the band application frame 5. The pivoted lever 19 is mounted pivotably, in the pivot direction 20, about a pivot axis 21 disposed below the working surface 2 of the working table 1 and extending in the direction of conveyance 4. The pivoting motion of the pivoted lever 19 therefore runs from the band application frame 5 in the pivot direction 20 toward the middle 11 of the packing unit and back once more in a return stroke.

Figure 7:
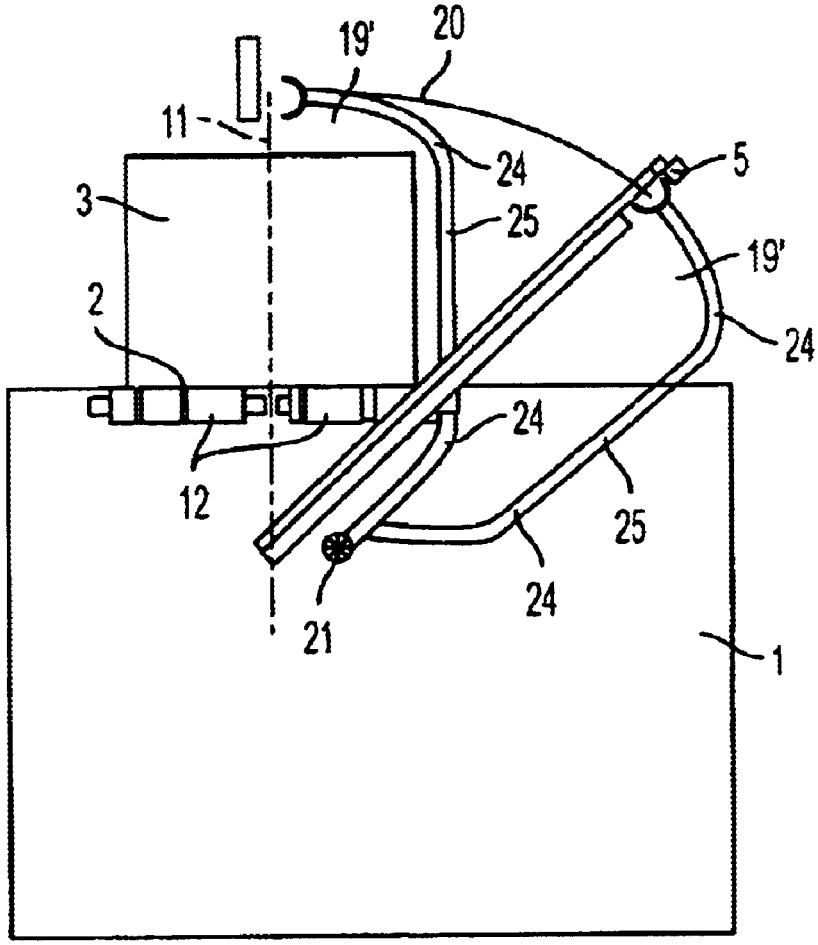

FIG. 7 also shows an embodiment of the invention but with a pivoted lever 19' modified with respect to the embodiment shown in FIG. 6. This pivoted lever 19' has two substantially right-angle bends 24. In this manner the pivoted lever 19' is configured as an easily manufactured bow, which has as a consequence the fact that the pivoted lever 19' with its perpendicular area 25 extending between the two right-angle bends 24 is always disposed adjacent to the packing unit 3 and thus leaves free sufficient free space for the packing unit 3. Thereby a collision of the pivoted lever 19' with the packing unit 3 is effectively avoided. Furthermore, the pivoted lever 19' also does not hinder the packing unit 3 when it is conveyed onto or off of the working surface 2 of the working table 1.

The above description of the preferred embodiments has been given by way of example. From the disclosure given, those skilled in the art will not only understand the present invention and its attendant advantages, but will also find apparent various changes and modifications to the structures and methods disclosed. It is sought, therefore, to cover all such changes and modifications as fall within the spirit and scope of the invention, as defined by the appended claims, and equivalents thereof.

What is claimed is:

1. Apparatus for hooping packing units, comprising:

a working table on which a packing unit can be placed during the hooping;

a band application frame, disposed fixed, eccentric and running obliquely relative to a working surface of said working table, and configured to apply a band loop from a band section of a hooping band; and at least one band-feeding element disposed at or on said band application frame;

wherein said band-feeding element traverses the band loop substantially into a middle of the working surface of said working table for hooping the packing unit in a direction of conveyance of the packing unit.

2. Apparatus according to claim 1, wherein said band-feeding element comprises a telescoping arm.

3. Apparatus according to claim 2, wherein said band-feeding element further comprises a pneumatic cylinder driving said telescoping arm.

4. Apparatus according to claim 2, wherein said band-feeding element further comprises an electromotive source driving said telescoping arm.

5. Apparatus according to claim 4, wherein said electromotive source is a linear motor.

6. Apparatus according to claim 1, wherein said band-feeding element comprises a band conveyor.

7. Apparatus according to claim 6, wherein said band conveyor comprises a transport belt.

8. Apparatus according to claim 7, wherein said transport belt is selected from the group consisting of a round belt, a wedge belt, a toothed belt, a profile belt, and a flat belt.

9. Apparatus according to claim 7, wherein said transport belt comprises two catches alternatingly engaging band loops from said band application frame.

10. Apparatus according to claim 1, wherein said band-feeding element comprises a pivot lever.

11. Apparatus according to claim 10, wherein said pivot lever comprises a bow offset to one side of the packing unit during the hooping of the packing unit.

12. Apparatus according to claim 11, wherein said pivot lever is offset in the direction of the conveyance of the packing unit.

13. Apparatus according to claim 10, wherein said pivot lever is bent at at least two locations, to form an overall bend in said pivot lever of substantially greater than 135°, and wherein said pivot lever laterally flanks the packing unit during the hooping of the packing unit.

14. Apparatus according to claim 1, wherein said band-feeding element comprises an air nozzle.

15. Apparatus according to claim 1, further comprising one additional band-feeding element, said band-feeding elements forming a pair of elements extending from said band application frame.

16. Apparatus according to claim 1, wherein said band application frame comprises a U-shaped bow.

17. Apparatus according to claim 16, wherein said band application frame is fixed as an inverted U and comprises U-legs forming lateral parts of said band application frame and a transverse U-yoke forming an upper part of said band application frame.

18. Apparatus according to claim 17, wherein said band application frame is affixed to said working table via said U-legs.

19. Apparatus according to claim 16, further comprising at least one additional band-feeding element, wherein each of said band-feeding elements is disposed respectively in a corner area of said U-shaped bow.

20. Apparatus according to claim 1, wherein said band application frame comprises a C-shaped guide groove that accommodates the band section forming the band loop.

21. Hooping apparatus, comprising:

a table having a working surface configured to receive a packing unit in a hooping area;

a frame configured to dispense a band loop, said frame being fixed against movement relative to said table and defining a planar area that extends from the working surface both at a non-perpendicular angle to the working surface and outside the hooping area; and a band-feeding element configured to transport the band loop from said frame into the hooping area.

22. The hooping apparatus according to claim 21, wherein said band feeding element is affixed to said frame and extends into the hooping area.

23. The hooping apparatus according to claim 21, wherein said band feeding element is affixed to said table and is configured to pivot between said frame and the hooping area.

* * * * *